United States Patent [19]

Kelley et al.

[11] 4,135,177

[45] Jan. 16, 1979

[54] THERMAL PROTECTIVE SWITCH

[76] Inventors: John R. Kelley; Harold G. Wyse, both of 3629 N. Dixie Dr., Dayton, Ohio 45414

[21] Appl. No.: 792,530

[22] Filed: May 2, 1977

[51] Int. Cl.[2] ..... H01H 37/76

[52] U.S. Cl. ..... 337/407; 337/408

[58] Field of Search ..... 337/407, 408, 409

[56] References Cited

U.S. PATENT DOCUMENTS

| | | | |
|---|---|---|---|
| 3,291,945 | 12/1966 | Merrill et al. | 337/407 |
| 3,820,050 | 6/1974 | Tyler et al. | 337/408 |
| 3,952,274 | 4/1976 | Plasko | 337/407 |
| 3,956,725 | 5/1976 | Merrill et al. | 337/407 |

*Primary Examiner*—Harold Broome

*Attorney, Agent, or Firm*—Jacox & Meckstroth

[57] ABSTRACT

A thermally sensitive switch is provided with two parallel lead wires or conductive members which are confined within a two section insulated housing. Electrical continuity between members is established by a conductive contact element which bridges the two conductive members to provide a continuous electrical path. The contact element is held in place by a temperature sensitive material which changes state at a predetermined temperature and by a spring element which exerts a force on the pellet through the contact element. When the temperature sensitive material changes state, the spring force drives the contact between the conductive members to effect a snap-action instantaneous interruption of the electrical circuit. The construction and assembly of the components provide for minimizing the production cost of the switch.

13 Claims, 4 Drawing Figures

THERMAL PROTECTIVE SWITCH

BACKGROUND OF THE INVENTION

Temperature sensitive or responsive switches, often referred to as "One-Shot" thermal cut-offs, are well known in the art, for example, as disclosed in U.S. Pat. Nos. 3,291,945, 3,820,050, 3,944,960 and 4,001,754. However, recent consumer safety trends have increased the need for a more reliable, easily manufactured thermal cut-off switch for use on electrical components and appliances. The majority of thermal cutoff switches presently being commercially used are complex in design and difficult to fabricate. In addition, most of the switches are constructed with an electrically conductive housing that is part of the electrical path and therefore requires an electrical insulator at the time of application. The circuit interruption of these switches is accomplished by a "slow-break," sometimes called a "creep-action." Accordingly, there is a need for a thermal cut-off switch which can be easily and inexpensively produced with an insulated housing, fewer moving parts, and a fast-break or snap-action circuit interruption.

SUMMARY OF THE INVENTION

In accordance with the present invention, a temperature sensitive switch is designed to provide a "snap-action" circuit interruption at a predetermined temperature. This is achieved by the change of state of a temperature sensitive material which permits a spring loaded contact element to separate irreversibly and interrupt a previously continuous electrical current path. Thus the device offers highly reliable circuit interruption with fewer parts and is adapted to be manufactured at lower costs.

The above features and advantages are provided in one embodiment of the invention by using an electrically insulated two section housing which encloses a spring loaded leaf type contact element which forms a current path between two parallel spaced conductive members or lead wires. A temperature sensitive material and a spring element position the contact element, and the spring element provides the force necessary to activate the device. The housing is molded of an electrically non-conductive material and consists of mating top and bottom section having means for positioning the internal components precisely in place.

The temperature sensitive material provides a base for supporting the contact element to provide continuity from one conductive member to another through the contact element. The force of the spring element provides the pressure to insure reliable contact pressure for circuit continuity. At a predetermined temperature, the temperature sensitive material changes state, permitting the element to force the contact element between the parallel spaced conductive members to interrupt the electrical circuit.

Other features and advantages of the invention will be apparent from the following description, the accompanying drawing and the appended claims.

DESCRIPTION OF THE PREFERRED EMBODIMENT

Figure 1:
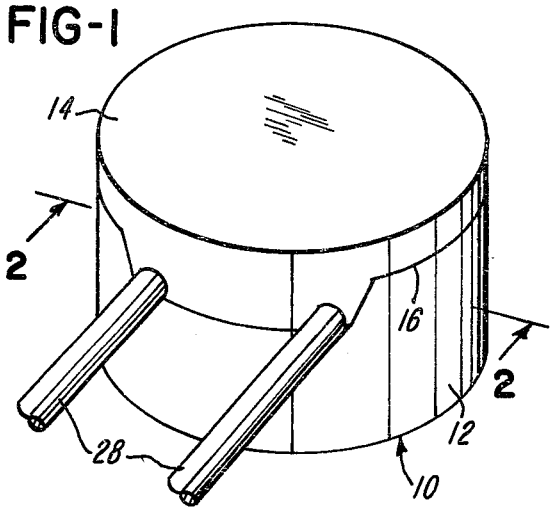
FIG. 1 is a substantially enlarged perspective view of a thermally sensitive switch constructed in accordance with the present invention.

For purpose of illustration, the thermal sensitive or protective switch shown in the drawing is substantially enlarged from its actual size which is approximately 5/16 inch in diameter. The switch includes a housing 10 formed by a bottom section 12 and a mating top section 14 each having a cylindrical outer surface. The housing sections 12 and 14 are formed of an electrically insulating material such as a thermoplastic or ceramic and are secured together by adhesive or ultrasonic welding at the abutting peripheral surfaces forming the joint 16. The bottom housing section 12 defines a cylindrical chamber or cavity 18 which extends to form a relatively thin bottom wall 19. A cylindrical body or pellet 22 of temperature sensitive material is confined within the cavity 18. The material is electrically nonconductive and is normally rigid or solid until exposed to a predetermined melting temperature for example, a temperature within the range of 130° F. to 800° F. The formulation of the material forming the pellet 22 is well known in the art and is disclosed in issued patents as well as published technical references.

Figure 4:
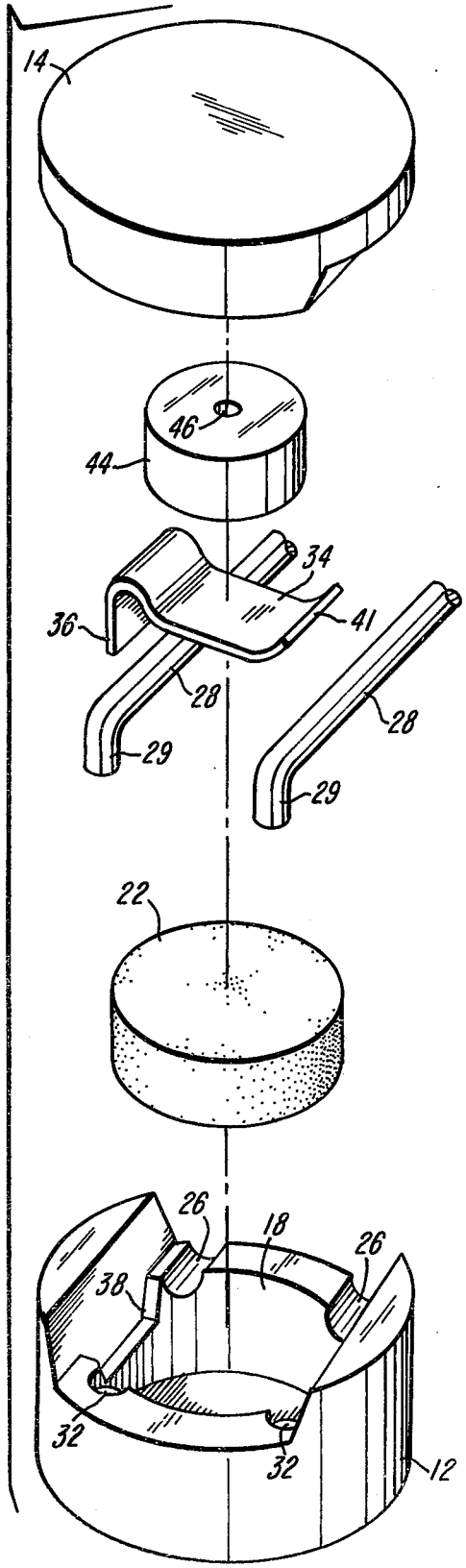
FIG. 4 is an exploded perspective view of the components of the thermally sensitive switch shown in FIGS. 1–3.

The bottom housing section 12 and the top housing section 14 cooperate to define a pair of parallel spaced cylindrical bores 26 (FIG. 4) which receive a corresponding pair of parallel spaced electrically conducting wires or conductors 28 such as copper wires. The conductors 28 have L-shaped inner end portions 29 which project downwardly and socket into corresponding blind holes 32 formed within the bottom housing section 12. The interfitting of the conductor end portions 29 into the socket holes 32 is effective to prevent twisting of the conductors 28 as well as prevent the conductors from being pulled axially after the conductors are sandwiched between the housing sections 12 and 14 within the bores 26.

Figure 2:
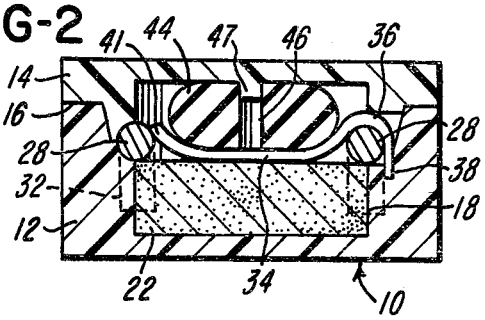
FIG. 2 is a section taken generally along the line 2—2 of FIG. 1 and showing the thermally sensitive switch in a position forming a continuous electrical circuit.

A leaf-type metal contact element 34 extends between the conductors 28 within the housing 10 and normally rests on the upper surface of the solid temperature sensing pellet 22, as shown in FIG. 2. The contact element 34 is formed from a thin sheet metal strip having a slight spring characteristic such as copper or silver cadmium oxide and has one end portion 36 with a hook-like configuration which seats on one of the conductors 28. The end portion 36 projects downwardly into a locating slot 38 (FIG. 2) formed within the bottom housing section 12. The opposite end portion 41 of the contact element 34 curves upwardly and normally seats on the opposite conductor 28, as also shown in FIG. 2.

The contact element 34 is urged into firm engagement with the conductors 28 by a spring element 44 to insure a positive electrical connection between the conductors 28 within the housing 10. The spring element 44 is formed of an annular body of resilient material such as silicone rubber which has excellent temperature and spring characteristic as well as a high coefficient of expansion. The spring element 44 has a center hole 46 which receives a center locating stud 47 (FIG. 2) formed as an integral part of the top housing section 14. The stud 47 positions the spring element 44 centrally within the housing 10 and directly over the contact element 34 so that the contact element is normally held in positive contact with the conductors 28 and the pellet 22 of temperature sensitive material.

Figure 3:
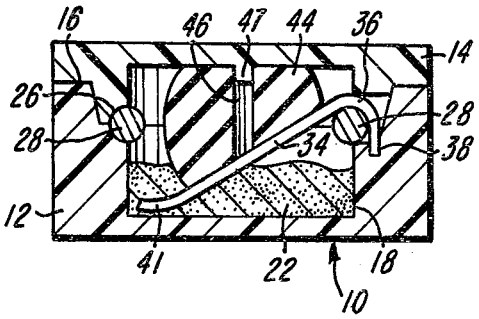
FIG. 3 is a section similar to FIG. 2 and showing the thermally sensitive switch after it has been actuated to interrupt the circuit.

In the operation of the thermal protective switch, when the pellet 22 senses a predetermined temperature by heat transfer through the bottom wall 19 of the housing 10, the pellet melts into a flowable state. The downward force exerted by the spring element 44 causes the contact element 34 to pivot downwardly as illustrated in FIG. 3. As the end portion 41 of the contact element 34 passes through a plane defined by the axes of the parallel wire conductors 28, the over-center condition produces a snap-action effect causing the end portion 41 to spring downwardly from the one conductor 28 thereby immediately interrupting the circuit. The expansion of the resilient spring element 44 forces the contact element 34 downwardly into the melted body 22 of temperature sensitive material.

It is apparent from the drawing and the above description that a thermal sensitive or protective switch constructed in accordance with the present invention, provides desirable features and advantages. For example, the switch is simple in construction and incorporates fewer components than normally required in commercially used thermal protective switches. In addition, the components are relatively inexpensive components, and the insulated case or housing 10 is desirable for many installations. The thermal protective switch of the invention also provides for snap actuation which is highly desirable to insure immediate or instantaneous interruption of the circuit and to prevent the possibility of arcing which can weld metal components together and maintain a short circuit. It is also apparent that the thermal protective switch described above may be used as a current sensing switch simply by selecting the material for the conductors 28 and/or contact element 34 with a predetermined resistance.

While the form of protective switch herein described constitutes a preferred embodiment of the invention, it is to be understood that the invention is not limited to this precise form of switch, and that changes may be made therein without departing from the scope and spirit of the invention as defined in the appended claims.

The invention having thus been described, the following is claimed:

1. A thermal switch comprising a housing, a set of elongated conductors having corresponding inner portions disposed within said housing, said inner portions of said conductors having corresponding center axes defining a plane, a contact element disposed within said housing and extending from said inner portion of one said conductor to said inner portion of the other said conductor, said contact element having a contact portion engaging said inner portion of one said conductor at a location spaced from the plane when said contact element is in a conducting position, a thermal sensing element disposed within said housing for normally retaining said contact element in said conducting position, said thermal sensing element being capable of changing from a rigid state to a melted state in response to being heated to a predetermined temperature, means associated with said contact element for urging said contact element from said conducting position to a spaced interrupted position in response to changing of said thermal sensing element to said melted state, and said contact portion passes between said inner portions and transversely through the plane when moving from said conducting position to said interrupted position to effect snap-action movement of said contact element.

2. A thermal switch as defined in claim 1 wherein said conductors comprise substantially parallel spaced wires each having a substantially circular cross-sectional configuration, and said plane is defined by the axes of said wires.

3. A thermal switch as defined in claim 1 wherein said contact element has a slight spring characteristic which produces an over-center snap-action as said contact element passes between said conductors from said conducting position into said interrupted position.

4. A thermal switch as defined in claim 1 wherein said urging means comprises a resilient rubber-like spring member compressed between said contact element and a wall portion of said housing.

5. A thermal switch as defined in claim 4 wherein said spring member has a center opening, and said housing includes means projecting into said opening for locating said spring member within said housing and relative to said contact element.

6. A thermal switch as defined in claim 4 wherein said spring member comprises silicone rubber.

7. A thermal switch as defined in claim 1 wherein said housing is cylindrical and includes a top section and a bottom section, said thermal sensing element is disposed within said bottom section, said urging means comprises a spring member disposed within said top section, and said conductors are disposed generally within a plane extending perpendicular to the axis of said housing.

8. A thermal switch as defined in claim 1 wherein said contact element comprises a thin strip of sheet metal having a substantially uniform thickness, and said strip has one end portion wrapping partially around one of said conductors.

9. A thermal switch as defined in claim 8 wherein said housing defines a slot which receives said one end portion of said contact element for locating said contact element within said housing.

10. A thermal switch as defined in claim 1 wherein said housing defines generally parallel spaced socket openings with parallel spaced axes, and said conductors have corresponding generally L-shaped end portions projecting into said openings to restrain pulling of said conductors axially from said housing.

11. A thermal switch comprising a housing, a set of elongated conductor wires disposed within said housing in generally parallel spaced relation, said conductors each having a center axis and including portions projecting from said housing, a thin leaf spring contact element disposed within said housing and extending from one said wire to the other said wire, said contact element having a wire contacting portion movable from a conducting position transversely through a plane defined by the axes of said wires to an interrupted position spaced from the plane, a thermal sensing element disposed within said housing for normally retaining said contacting portion of said contact element in said conducting position, said thermal sensing element being capable of changing from a rigid state to a melted state in response to being heated to a predetermined temperature, and spring means for urging said contact element through said plane and toward said interrupted position in response to changing of said thermal sensing element to said melted state.

12. A thermal switch as defined in claim 11 wherein said spring means comprise a resilient rubber-like spring member compressed between said contact element and a wall portion of said housing.

13. A thermal switch as defined in claim 11 wherein said housing is generally cylindrical in configuration, and each said conductor wire extends from said housing generally within a radial plane.

* * * * *